US006976477B2

(12) United States Patent
Gimby et al.

(10) Patent No.: US 6,976,477 B2
(45) Date of Patent: Dec. 20, 2005

(54) SYSTEM AND METHOD FOR CAPTURING HYDROCARBON EMISSIONS DIFFUSING FROM AN AIR INDUCTION SYSTEM

(75) Inventors: David R. Gimby, Livonia, MI (US); Neville J. Bugli, Novi, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 0 days.

(21) Appl. No.: 10/283,003

(22) Filed: Oct. 29, 2002

(65) Prior Publication Data

US 2004/0079344 A1 Apr. 29, 2004

(51) Int. Cl.[7] ..... F02M 37/04
(52) U.S. Cl. ..... 123/519; 123/516
(58) Field of Search ..... 123/519, 520, 123/518, 516, 521, 510

(56) References Cited

U.S. PATENT DOCUMENTS 3,665,906 A * 5/1972 De Palma ..... 123/519
3,813,347 A * 5/1974 Hayes ..... 502/402
3,826,237 A * 7/1974 Csicsery et al. ..... 123/179.17
3,838,673 A * 10/1974 Csicsery et al. ..... 123/179.8
5,033,465 A * 7/1991 Braun et al. ..... 128/205.27
5,453,118 A * 9/1995 Heiligman ..... 96/147
5,776,385 A * 7/1998 Gadkaree et al. ..... 264/29.5
6,537,355 B2 * 3/2003 Scardino et al. ..... 96/147

FOREIGN PATENT DOCUMENTS

EP 1 110 593 A1 6/2001
GB 2 082 935 A 3/1982

OTHER PUBLICATIONS

K. Robinson, R. Mieville, H. Schroeder, "Development of Carbon Adsorption Blocks for Evaporative Loss Control," Retrieved on Mar. 20, 2003 from Mega-Carbon Center website using Internet <URL:http:/www.megacarbon.com/techlit/evapemis.pdf>.

* cited by examiner

*Primary Examiner*—Carl S. Miller
(74) *Attorney, Agent, or Firm*—Brinks Hofer Gilson & Lione

(57) ABSTRACT

An invention for controlling hydrocarbon emissions diffusing from a throttle body through an air path of an air induction system after engine shut-off. The invention includes a pourous membrane loaded with carbon positioned in fluid communication with the emissions for adsorbing the emissions.

20 Claims, 2 Drawing Sheets

SYSTEM AND METHOD FOR CAPTURING HYDROCARBON EMISSIONS DIFFUSING FROM AN AIR INDUCTION SYSTEM

BACKGROUND OF THE INVENTION

1. Field of the Invention

The invention relates to controlling hydrocarbon emissions diffusing from a throttle body through an air path of an air induction system after engine shut-off.

2. Background Art

Partial Zero Emission Vehicle (PZEV) standards have been enacted to provoke automotive manufacturers into producing environmentally friendly vehicles. These standards set more stringent hydrocarbon emission requirements.

To meet these new more stringent hydrocarbon vapor emission requirements, especially for internal combustion engines, a reduction of the amount of hydrocarbon vapor emissions from all sources may be reviewed. Particularly, the diffusion of hydrocarbon vapor emissions through an air induction system after engine shut-off.

Hydrocarbon vapor emissions are adsorbed with carbon materials. For example, slurring is a process where carbon is arranged within a watery mixture for surface coating conduit walls of the air induction system.

Slurring methods, and the like, are expensive processes, particularly when applied inside conduits or as an extra step in the manufacturing of the air induction system. Moreover, the slurring substances applied with the carbon tend to become brittle and break off into the air induction system, which can cause particles and other items to travel through the throttle body and into the engine.

SUMMARY OF THE INVENTION

One aspect of the present invention relates to an air induction system for an engine. The air induction system includes an air path from an inlet to a throttle body for directing fresh air from the inlet to the throttle body. Within the air path is at least one porous membrane loaded with carbon and positioned for receiving within the membrane at least a portion of hydrocarbon emissions diffusing through the air path after engine shut-off for adsorbing the emissions.

Another aspect of the present invention relates to a method for controlling hydrocarbon emissions diffusing from an engine through an air path used to direct fresh air from an inlet to a throttle body of the engine after engine shut-off. The method includes positioning a porous membrane loaded with carbon in fluid communication with the air path for receiving within the membrane for adsorption at least a portion the hydrocarbon emissions diffusing from the engine after engine shut-off.

Yet another aspect of the present invention relates to an emissions controller. The emissions controller comprising an porous membrane loaded with carbon and positioned in fluid communication with at least a portion of the air path for receiving within the membrane hydrocarbon emissions diffusing through the air path after engine shut-off.

DETAILED DESCRIPTION OF THE PREFERRED EMBODIMENTS

Figure 1:
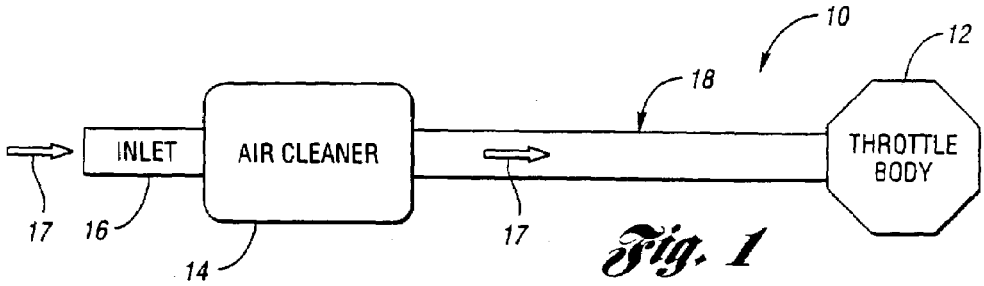
FIG. 1 is a diagrammatic view of a prior art air path for an air induction system for an engine.

FIG. 1 illustrates an air induction system 10 for delivering fresh air to an engine. The induction system 10 includes a throttle body 12, an air cleaner 14, and a fresh air inlet 16 for admitting fresh air 17 that is delivered along air path 18 to the engine.

When the engine is running, the fresh air 17 flows through the air cleaner 14 and into the throttle body 12 for combustion in the engine. Typically, the air path 18 comprises a dual-durometer elastomeric material.

Figure 2:
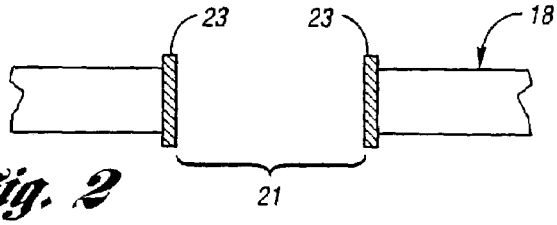
FIG. 2 is a view of a gap in the air induction system.

As shown in FIG. 2, the air path 18 can separate to include a gap 21. The gap 21 allows other component parts to be installed in the air path 18, as described in greater detail below. Preferably, securement devices 23, like rubber sleeves, are provided for assistance with securing the installed components.

When the engine is shut-off, a concentration gradient develops between hydrocarbon vapors remaining in the engine, and the air remaining in air path 18. The gradient results from a pressure differential or temperature differential. The gradient induces the diffusion of the hydrocarbons as emissions that travel through the air path 18 from the throttle body 12 to the inlet 16, as shown in the partial diagrammatical view of the air path 18 of FIG. 3.

The diffusing hydrocarbon emission randomly flow toward the inlet 16. The light molecules 20 tending to drift toward one side of the air path 18 and the heavier molecules 22 tending to drift toward another side of the air path 18. The diffusing vaporized hydrocarbon vapor emissions eventually travel out into the environment.

Partial Zero Emission Vehicle (PZEV) standards have been enacted to reduce the amount of hydrocarbon emissions diffusing from engines when the engine is shut-off. One aspect of the PZEV standards requires the vehicles having the engines to pass a sealed housing for evaporative determination test (SHED). The SHED test measures the amount of hydrocarbons emitted and determines if the vehicle meets applicable regulatory standards. Upon review, preliminary measurements have shown that as much as 5 g, or more, of the hydrocarbon vapors can leak through the throttle body 12 at shut-off from the diffusion described above.

As described with more detail below, the present invention installs an membrane, having activated carbon loaded or impregnated therein to adsorb the diffusing hydrocarbon emissions. The membrane can comprise any number of materials and structures which may be loaded with carbon. Preferably, the membrane is a permeable porous foam loaded with Zeolite. The foam can be open cell and closed cell foam, the open cell foam can be a reticulated open cell polyurethane foam.

The porous membrane allows for air flow to permeate through passageways defined by cavities and recesses in the membrane. Carbon is loaded into the cavities and recesses to form a coating of carbon on the passageways. For example, the carbon is arranged into a pasty substance and massaged, sprayed, or soaked through the membrane. The cavities and recesses provide a maze of passageways through which the diffusing light molecules 20 and heavy molecules 22 interact with the carbon for adsorption. The membrane can be any other permeable porous substance, like a cluster of fibers. The carbon can be loaded onto the fibers with a spray or included as part of the fibers.

As the amount, or volume, of carbon required to adsorb the hydrocarbons is proportional to the amount of diffusing hydrocarbon, a known volume of carbon is required for proper adsorption.

The present invention discloses a number of configurations for the membrane which have various benefits. The size, shape, and occlusiveness of the membrane on intake air flow 17 restriction is balanced with the adsorption ability of the particular size, shape, and occlusiveness of the membrane. In other words, a trade-off exists between air flow restriction and adsorption capabilities. Often, when restriction is high, adsorption is high. However, when restriction is low, adsorption is low.

Figure 4:
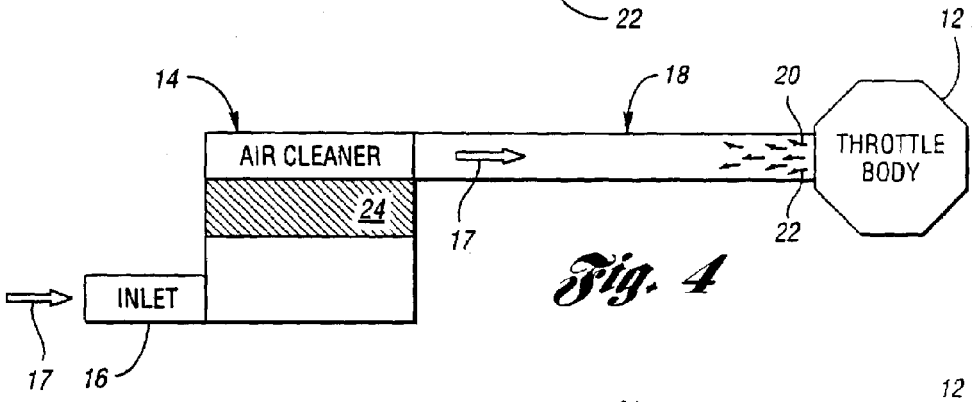
FIG. 4 is a diagrammatic view showing a membrane installed in an air cleaner in accordance with the present invention.

FIG. 4 is a diagrammatic view of the air induction system 10 showing one variation of a membrane 24. The membrane 24 is installed in the air cleaner 14 of the air induction system 10. The membrane 24 is affixed to the air cleaner with an adhesive or mechanical fasteners.

Advantageously, the membrane 24 can install within existing air cleaners 14 cheaply and without having to replace the entire air cleaner 14. Moreover, the relatively larger width of the membrane 24 with respect to the cross-section of the air path 18 allows the membrane 24 to include a large volume of carbon at a minimum thickness. The restriction on intake air flow is minimized while the adsorption of the hydrocarbons is relatively good. Even more, a large portion of the membrane's surface is in the intake air flow 17 which helps recycle the adsorbed hydrocarbon back to the engine when the engine is running.

Figure 5:
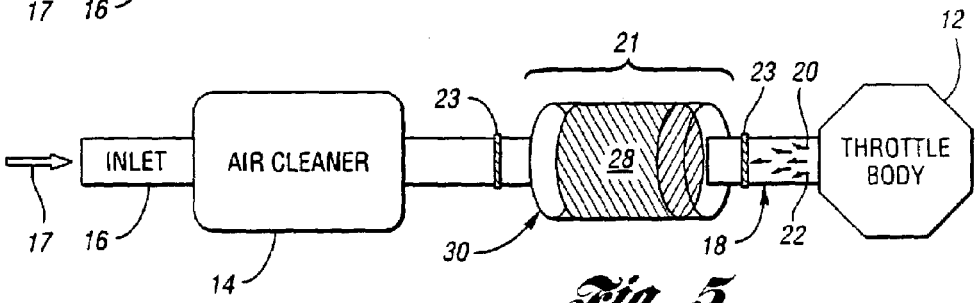
FIG. 5 is a diagrammatic view showing a membrane installed in a housing in the air path in accordance with the present invention.

FIG. 5 is a diagrammatic view showing a membrane 28 installed in a housing 30 in the air path 18. The housing 30 is secured using the securement devices 23. Preferably, the membrane 28 has a cross-section which is larger than the cross-section of the air path 18. If the housing 30 is not used, the membrane 28 is pressed into the air path 18.

Figure 3:
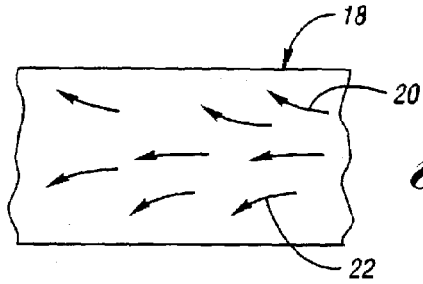
FIG. 3 is a diagrammatic view of diffusing vaporized hydrocarbon emissions.
Figure 6:
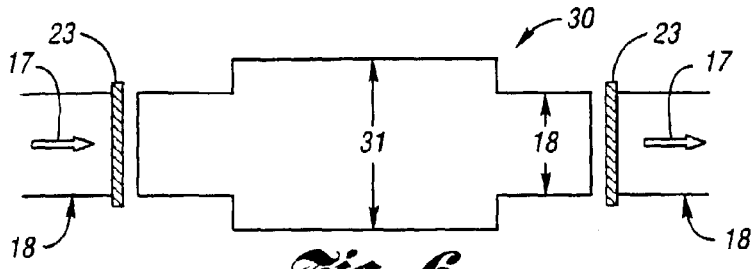
FIG. 6 is a diagrammatic view of the housing.

As shown in FIG. 6, the housing 30 includes an expansive portion 31 which is larger than air path 18. The housing 30 need not be larger than the cross-section of the air path 18. As the intake flow 17 travels at a rather high velocity, the intake flow 17 tends not to flow out beyond air path 18 and into the more expansive portion 31. Consequently, the expansive portion 31 allows for a larger volume of the membrane 28 outside the cross-section of the air path 18 for minimized flow restriction. Yet, the random distribution of the vaporized emissions, as shown in FIG. 3, still migrates beyond the air path 18 into the expansive portion 31 for adsorption.

The membrane 28 shown in FIG. 5 is fully occlusive to the diffusing hydrocarbon vapors, much like the membrane 24 in the air cleaner 14, but with less restriction as some of the required carbon is outside the cross-section of the air path 18.

Figure 7:
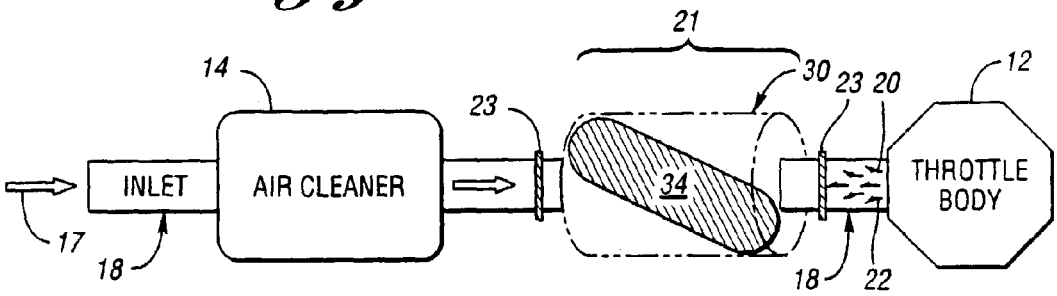
FIG. 7 is a diagrammatic view showing a membrane angled in the housing in accordance with the present invention.

FIG. 7 is a diagrammatic view showing a membrane 34 which is positioned within the housing 30 at an incline from one side of the expansive portion 31 to an opposite and non-adjacent side. In comparison to the membrane shown in FIG. 5, a greater amount of surface area of the membrane 34 is exposed to the flow of air, but the thickness is reduced. Reducing the thickness decreases restriction while maintaining relatively good adsorption efficiency.

Figure 8:
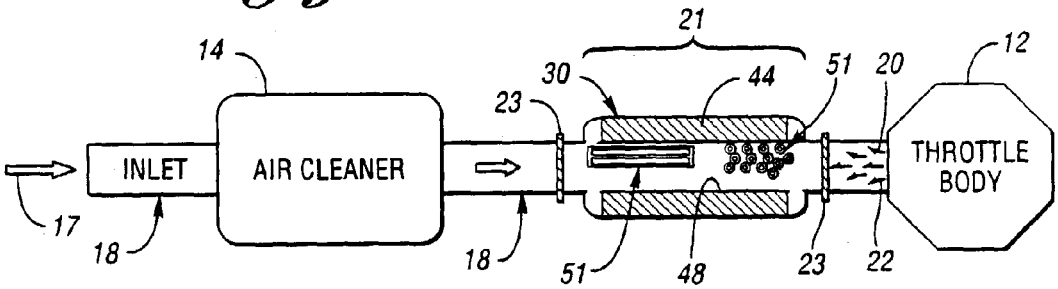
FIG. 8 is a diagrammatic view showing a membrane in the housing wherein the membrane is positioned around a tube in accordance with the present invention.

FIG. 8 is a diagrammatic view showing a membrane 44 disposed around an outer surface of a tube 48 suspended within the housing 30. Preferably, the tube 48 includes apertures 51 for the hydrocarbon molecules to pass through to the membrane 44. The apertures 51 can be shaped into any configuration, such as an elongated slot or a circle. The tube 48 separates the membrane 44 within the expansive portion 31 and outside the cross-section of the air path 18 to limit the restriction on air flow.

Figure 10:
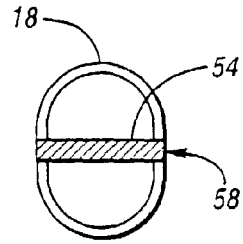
FIG. 10 is a cross-section of FIG. 9.
Figure 9:
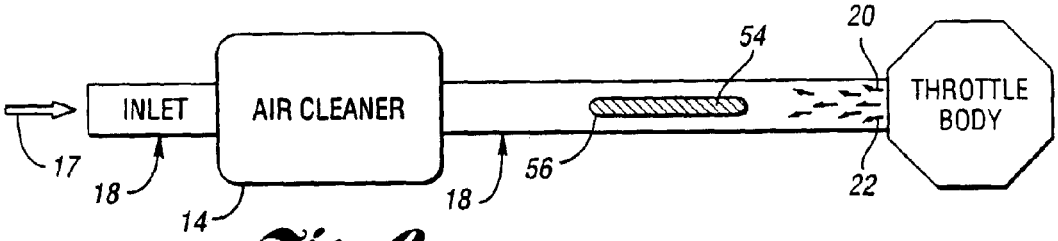
FIG. 9 is a diagrammatic view showing a membrane positioned to partition the air path in accordance with the present invention.

FIG. 9 is a diagrammatic view showing a membrane 54 used to partition the air path 18. The membrane 54 includes rounded ends 56 for deflecting the flow of intake air flow 17 for minimal restriction. As shown in the cross-section of FIG. 10, the air path 18 defines a cross-sectional area which is partitioned by the membrane 54. The air path 18 can include slots 58 for securing the membrane 54. The membrane 58 could be installed with the housing 30, with or without the expansive portion 31, like the membranes described above.

Figure 11:
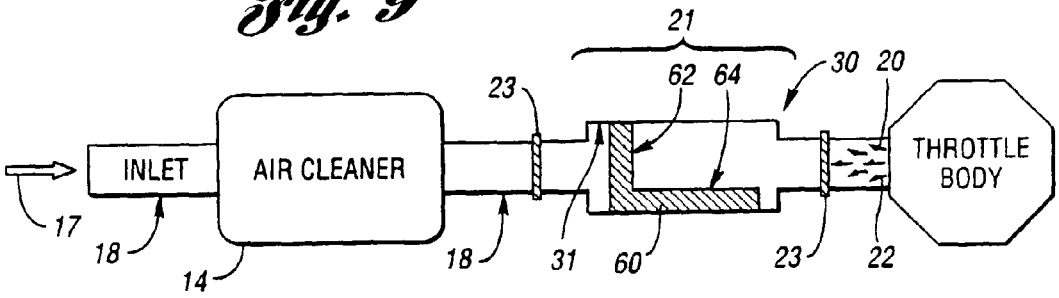
FIG. 11 is a diagrammatic view showing a membrane having two differently shaped portions in the housing in accordance with the present invention.

FIG. 11 is a diagrammatic view of a membrane 60. The membrane 60 is shown secured within housing 30, but the membrane could similarly press-fit in the air path 18. The membrane 60 includes a first portion 62 which covers the air path 18 and a second portion 64 which does not cover the air path 18.

Advantageously, the membrane 60 includes a minimal restriction on air flow as the thickness of the first portion 62 is relatively low, but sufficient for adsorbing the light particulates 20, while the thicker, but less occlusive second portion 22, adsorbs the heavy particulates 22, which tend to fall before reaching the first portion.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An air induction system for an engine comprising:

an air path from an inlet to a throttle body, the air path directing fresh air from the inlet to the throttle body;

at least one porous membrane loaded with carbon, wherein the membrane is positioned in fluid communication with the air path for receiving within the membrane at least a portion of hydrocarbon emissions diffusing through the air path after engine shut-off for adsorbing the emissions; and wherein the membrane is positioned within the air path, the membrane having a first portion extending substantially across the air path in a first direction and a second portion at least partially extending along a surface of the air path in a second direction that is substantially perpendicular to the first direction and substantially parallel to the air path so that restriction on air flow is minimized while the adsorption of emissions is maximized.

2. The system of claim 1 wherein the membrane is permeable.

3. The system of claim 1 wherein the membrane is a foam.

4. The system of claim 1 wherein the membrane is a plurality of fibers.

5. The system of claim 1 wherein the air path has at least a portion with a defined cross-sectional area, and the first portion of the membrane substantially extends across the cross-sectional area.

6. A method of controlling hydrocarbon emissions diffusing from an engine after engine shut-off, the engine having an air path directing fresh air from an inlet to a throttle body of the engine, the method comprising:

positioning a porous membrane loaded with carbon within a conduit at least partially defining the air path for receiving at least a portion of the diffusing hydrocarbon emissions; and limiting restriction of air flow by minimizing a thickness of the membrane and maximizing adsorption by providing a first portion and a second portion of the porous membrane, the first portion extending substantially across the air path in a first direction that is substantially perpendicular to the air path and the second portion extending along a surface of the conduit in a second direction that is substantially perpendicular to the first direction.

7. The method of claim 6 wherein the air path has at least a portion with a defined cross-sectional area, and the first portion of the membrane is positioned to substantially cover the cross-sectional area.

8. The method of claim 6 further comprising installing a housing defining at least a portion of the air path.

9. The method of claim 8 further comprising positioning the membrane in the housing prior to installing the housing.

10. The method of claim 6 further comprising recycling at least a portion of the adsorbed hydrocarbon emissions back to the engine when the engine is running.

11. In an air induction system for an engine, the air induction system including an air path directing fresh air from an inlet to a throttle body, an emissions controller comprising:

a porous membrane loaded with carbon, wherein the membrane is positioned within a conduit at least partially defining the air path for receiving within the membrane hydrocarbon emissions diffusing through the air path after engine shut-off for adsorbing of the diffusing emission, the membrane having first and second portions cooperating to define an L-shaped component, the first portion extending substantially across the air path in a first direction and the second portion extending along a surface of the conduit in a second direction that is substantially perpendicular to the first direction so that restriction on air flow is minimized while the adsorption of emissions is maximized.

12. The emissions controller of claim 11 wherein the membrane is a foam.

13. The system of claim 1 wherein the first direction is substantially perpendicular to the air path and the second direction is substantially parallel with the air path.

14. The system of claim 13 wherein the air path is at least partially defined by a tube, the first portion extends substantially across the tube, and the second portion extends along a surface of the tube.

15. The system of claim 14 wherein the first portion includes a first thickness measured along the second direction and the second portion includes a second thickness measured along the first direction that is substantially equal to the first thickness.

16. The system of claim 1 wherein the first portion and the second portion cooperate to define an L-shaped component.

17. The method of claim 6 wherein the first portion includes a first thickness measured along the second direction and the second portion includes a second thickness measured along the first direction that is substantially equal to the first thickness.

18. The method of claim 6 wherein the first portion and the second portion cooperate to define an L-shaped component.

19. The system of claim 1 wherein the second portion of the membrane extends substantially along the surface of the conduit in the second direction.

20. The system of claim 1 wherein the second portion of the membrane is not positioned across the air path.

* * * * *